US005921174A

United States Patent [19]

Anthony

[11] Patent Number: 5,921,174

[45] Date of Patent: Jul. 13, 1999

[54] APPARATUS AND PROCEDURE FOR PLACEMENT OF BALE TIES

[75] Inventor: William S. Anthony, Greenville, Miss.

[73] Assignee: The United States of America as represented by the Secretary of the Agriculture, Washingon, D.C.

[21] Appl. No.: 08/876,800

[22] Filed: Jun. 16, 1997

[51] Int. Cl.[6] ..... B65B 13/20; B65B 13/06; B65B 27/12

[52] U.S. Cl. ..... 100/3; 100/7; 100/14; 100/25; 100/34

[58] Field of Search ..... 100/1–3, 7, 8, 100/14, 25, 26, 34, 257, 264, 269.18; 53/399, 438, 529, 590, 592

[56] References Cited

U.S. PATENT DOCUMENTS

| | | | |
|---|---|---|---|
| 95,127 | 9/1869 | More | 100/264 |
| 344,659 | 6/1886 | Johnson | 100/289 |
| 1,542,255 | 6/1925 | Leslie | 100/264 |
| 3,831,511 | 8/1974 | Back | 100/264 |
| 4,256,032 | 3/1981 | Davis | 100/3 |
| 4,382,405 | 5/1983 | Buttner | 100/7 |
| 4,438,689 | 3/1984 | Simich | 100/3 |
| 4,483,245 | 11/1984 | Fetters | 100/264 |

FOREIGN PATENT DOCUMENTS

| | | | |
|---|---|---|---|
| 2739791 | 3/1979 | Germany | 100/14 |

OTHER PUBLICATIONS

Article entitled "How to Make Small Paper Baler" from Popular Mechanics, p. 188. Aug. 1946.

*Primary Examiner*—Stephen F. Gerrity
*Attorney, Agent, or Firm*—M. Howard Silverstein; John D. Fado; Joseph A. Lipovsky

[57] ABSTRACT

A device for placement of bale ties to effect repair of cotton bales which have been damaged as a result of bale tie failure, includes a base frame structure and a pair of compression platens provided with elongated, generally longitudinally extending bale contacting and compressing surfaces. The platens are mounted on the structure for relative intraplanar movement toward and away from one another, with the compression surfaces disposed in substantial parallelism. The platens are positioned for compressing a damaged cotton bale therebetween as the platens move toward one another. The compression surfaces of the platens have a width which is sufficiently small to compress a damaged cotton bale only in close proximity to a position where a single replacement bale tie is to be placed. A drive mechanism is coupled to the platens for moving the latter relatively toward one another to effect bale compression.

21 Claims, 10 Drawing Sheets

APPARATUS AND PROCEDURE FOR PLACEMENT OF BALE TIES

BACKGROUND OF THE INVENTION

1. Field of the Invention

This invention relates to the placement or replacement of bale ties on bundles or bales of compressed solid material. Particular application exists with regard to the repair and recompression of cotton bales that have been damaged due to the loss or improper functioning of one or more bale ties.

2. Description of the Prior Art

Presently approximately 18 to 20 million bales of cotton, each weighing about 500 pounds, are produced in the United States annually. They are formed in the typical cotton gin at the rate of one every 2 to 3 minutes. This is done by having the cotton fiber fed down an inclined plane into a preliminary tramping mechanism which forces the cotton into a typically rectangular enclosure. Once this enclosure contains the desired amount of cotton, it is then rotated to a second position where considerable compressive force is applied for baling.

Most gin presses have two rectangular enclosures, one to store cotton during ginning and the other to do the actual compression. The cotton bale is formed by its compression between a pair of 20×54-inch rectangular plates, or platens, to which a force ranging from about 600,000 to about 1,000,000 pounds is applied. The platens conventionally have six to eight grooves therein that are about one-inch wide and two inches deep. These facilitate the insertion of bale ties once the bale is compressed to a density of about 42 pounds per cubic foot, which corresponds to a thickness of about 19 to 20 inches. These bale ties, comprising of round steel wires or flat straps made of steel or polyester, are then made to encircle the bale and their loose ends connected together. The compressive mechanism is then released and the bales are allowed to expand to a thickness that the restraining bale ties permit, this conventionally ranges from about 26 to 32 inches. Final bale dimensions are thus typically about 21 inches by 55 inches by 26 to 32 inches.

Bale tie failure, caused by such factors as improper tie-off, improper matching of bale ties to compression density, uneven cotton distribution within the bale, low moisture content, defective ties, and improper storage or handling, is a significant problem which plagues the cotton industry. While specific statistics are not kept on the number of bale tie failures during a typical year, it is estimated that about 4% or over 800,000 bales, experience tie failures annually. Bale failure rates in excess of 10% annually have however been reported at some large storage facilities. Typically, from one to four ties break in a given bale, thereby allowing it to expand from its original thickness of 26 to 32 inches up to about 38 to 42 inches. Bales damaged through loss of bale ties are rejected by mill customers due to their increased susceptibility to contamination and their loss of physical conformity to the mill's processing machinery.

Repair procedures in the past have included such approaches as recompression of the entire bale in conventional baling equipment or manually cinching a replacement tie around the bale. The deficits in these approaches are that use of the baling equipment requires that the gin not be processing cotton at the time, the bale expands to dimensions greater than the press opening and the bale must be completely unpackaged, and manual cinching may fail to adequately reconstrain the bale.

Warehouses handling large volumes of cotton bales have been compelled, as a result of this situation, to dedicate expensive large scale bale presses for accomplishing bale tie replacement. Smaller gins and warehouses having insufficient bale tie failures to justify the major expenditure for a bale press must ship the defective bales back to the gin of origin for repair at significant cost, in order to make them acceptable for market. Aside from transportation, repair costs range from $10 to $35 per bale, depending on the availability of a bale press. This works out to a cost of $8 to $28 million for repair of the 800,000 bales damaged annually.

U.S. Pat. No. 4,438,689 to Simich teaches a method to apply wire to a material baling device which comprises a pair of wide platens, each containing at least one recessed channel for use with placement of bale tie wires. The device includes a power feed assembly designed to guide the bale tie wires through the platen channels so that their placement and securing is made less labor intensive.

U.S. Pat. No. 4,509,416 to Simich teaches bale tie joining devices for securing bale tie ends on the top of the bale, wherein the completed tie joint or knot is readily visible to the press operator from the top prior to bale release.

SUMMARY OF THE INVENTION

The shortcomings of prior machines and methods for repairing bale tie failure in cotton bales are addressed and essentially minimized through the use of the device and methodology provided by the present invention. The device includes a base frame structure which is sufficiently compact so as to be readily transportable. The device further includes platens, each having a longitudinally extending major axis, capable of independent translation within a common plane of action defined by said frame. These platens have elongated, generally longitudinally extending surfaces for bale contact and compression. The platens are mounted on the base frame structure for relative movement toward and away from one another, with the major axes of the compression surfaces disposed in substantial parallelism to another.

In accordance with the invention, the platens are positioned for compressing a damaged bale therebetween by movement within the same plane toward one another. The compression surfaces of the platens each have a cross-sectional dimension in a direction perpendicular to the major axis thereof, which is sufficiently small so as to allow compression of a damaged bale only in close proximity to the location on the bale where the intended bale tie is to be placed. The device further includes a drive mechanism that is mechanically coupled to the platens and is operable, to move the platens relatively toward one another.

In accordance with a preferred form of the invention, a longitudinally extending bale tie receiving recess may be provided in at least one of the compression surfaces. Advantageously, a longitudinally extending bale tie receiving recess may be provided in the compression surface of each of the platens.

In a preferred embodiment of the invention described in this application, the frame structure may include a pair of spaced, upright beam members, each of which is provided with a guide track that extends there along. The platens are preferably elongated and each has a pair of spaced ends. The platens are disposed so as to extend between the beam members and so that the respective ends thereof are received in a corresponding guide track.

In accordance with the invention, the drive mechanism may include one or more cylinder assemblies operable by any art known means including mechanical, hydraulic or pneumatic. This drive mechanism may, in the alternative, include one or more manually operated jacks.

In another form of the invention, the longitudinally extending bale contacting and compressing surfaces of the platens may be triangular in cross-section and present a v-shaped nose portion disposed to point toward a damaged bale to be repaired. Such a conformation concentrates and localizes the compression forces applied during the repair operation.

The device of the invention may also include a conveyor apparatus situated beside the base frame structure. Such a conveyor apparatus may be disposed so as to transport a damaged bale to a repair zone located between the platens.

The invention also provides a method for repairing bales which have been damaged as a result of bale tie failure. The method includes placing a damaged bale in a repair zone and thereafter compressing the damaged bale only in the area proximate to the position where a single bale tie is to be placed and, while the bale is compressed, installing a bale tie around the bale.

The device of the invention provides an efficient and economical apparatus for conducting the method of the invention.

DETAILED DESCRIPTION OF THE PREFERRED EMBODIMENTS

In accordance with the invention, an inexpensive, transportable device is provided for recompressing damaged bales only in the vicinity of a missing or defective tie, thereby allowing replacement of one or more broken bale ties. The device employs an innovative compression platen that, in the case of cotton, is typically about 0.75 inches wide and about 21 inches long. A longitudinally extending bale tie accommodating recess may be provided in the compression surface of the platen. This recess is dimensioned to accommodate the particular bale tie being used. In the case of cotton, a 0.25 inch width is desirable when conventional wire ties are being utilized; a wider recess width, typically about 0.75 inches, may be preferred in the case where bands are utilized as bale tie devices. The recess itself may be of any desired configuration such as a simple groove, however, in a preferred embodiment the recess has an inverted keyhole-type cross-section. This configuration allows for ready placement of the bale tie in the platen recess even after bale compression, and the tie's ready release from the platen recess upon platen separation from the bale. Each platen of the preferred embodiment of the present invention provides a compression area of about 15.75 square inches, in contrast to the 1,080 square inches associated with the typical baling compressor platen. Broadly, the invention provides elongated compression platens having compression surfaces that are less than about 4 inches in width, to minimize the force needed to compress a damaged bale at each position where a replacement tie is to be installed.

Replacement bale ties may be individually placed in the recesses of the platens before the bale is moved into the plane of repair. After the bale is compressed at the localized area where a tie is to be replaced, a new tie is inserted and the ends of the new tie are then joined together in a conventional manner. An advantage of the instant invention over the prior art is the use of a focused compressive force sufficient to reduce the size of the bale and allow placement of a single tie, as compared to the usage of only generalized forces in the prior art.

Figure 1:
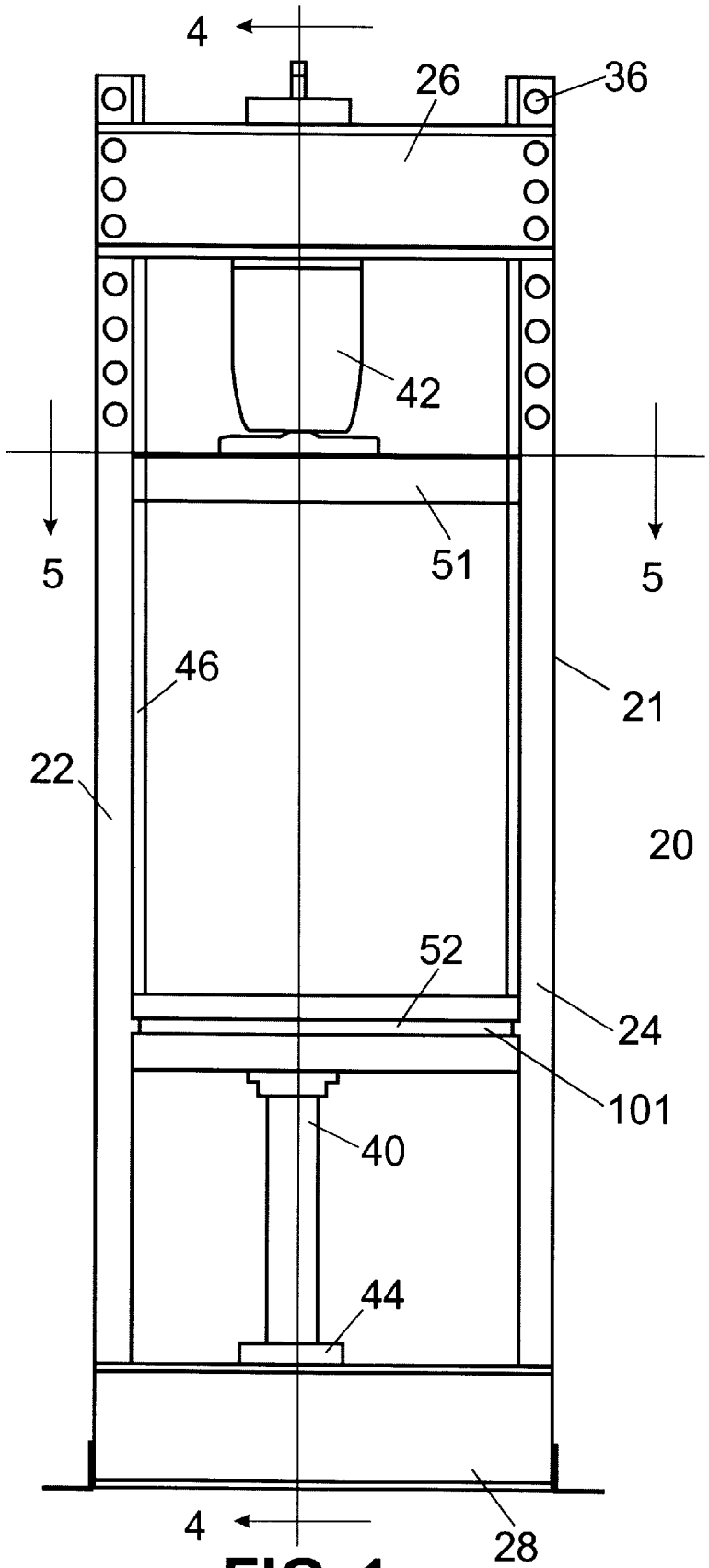
FIG. 1 is a front elevational view of the invention.
Figure 2:
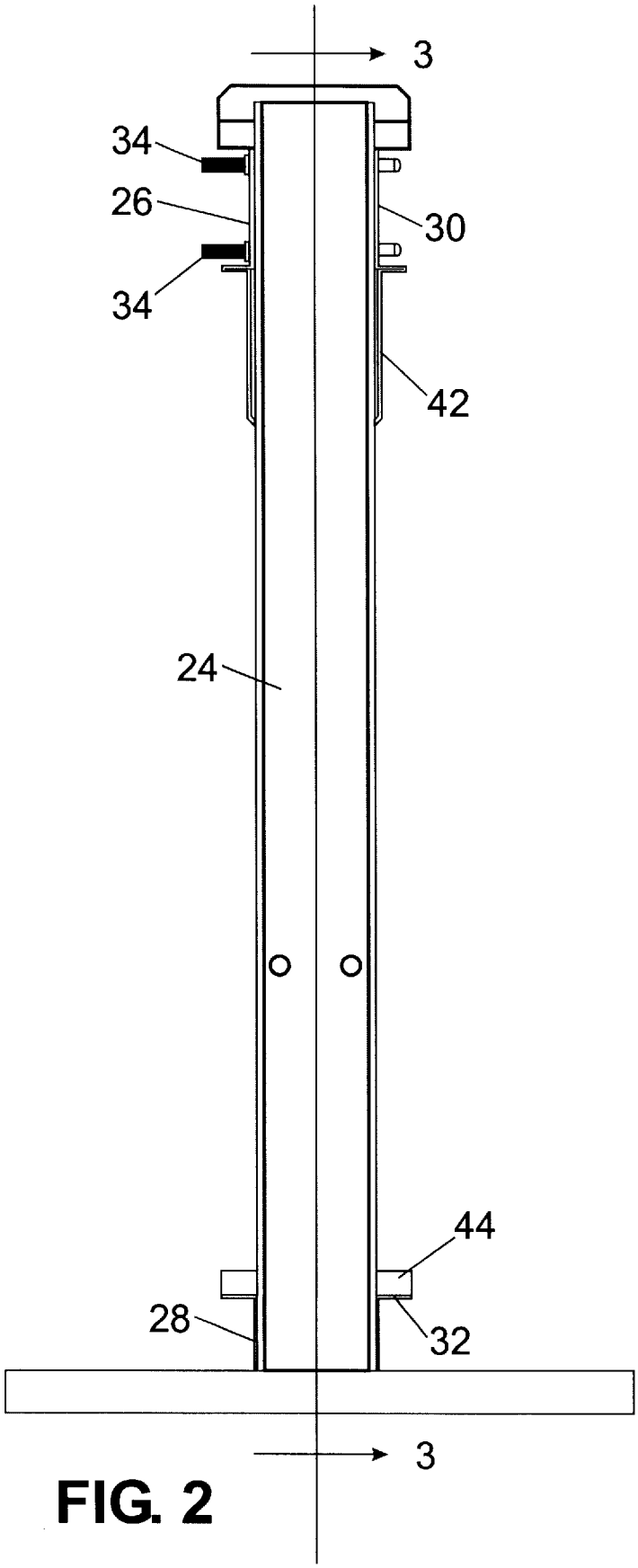
FIG. 2 is a side elevational view of the invention looking leftwardly at the device of FIG. 1.

A device for placing bale ties in accordance with the present invention is illustrated in FIG. 1, and is broadly identified by the reference numeral 20. Device 20 includes a frame structure 21 which is made up of a pair of beam members, 22 and 24, and cross beam members 26, 28, 30 and 32 (see FIG. 2). The beam members are preferably constructed from iron or steel and may be C-shaped as shown. The dimensions of the beam members are not critical so long as the frame has sufficient strength and rigidity to withstand the forces exerted in reaction to the application of compressive forces on a bale by the platens.

The lower cross beam members 28 and 32, may be attached to the beam members 22 and 24, by any conventional means such as mechanical fasteners or by welding. The upper cross beam members 26 and 30, are removably secured to beam members 22 and 24, using a fastening means such as pins 34 (see FIG. 2), which facilitate longitudinal adjustment of the position of the cross beam members 26 and 30, relative to beam members 22 and 24. For this purpose, a series of holes 36, may be provided in the flanges 22*a* and 24*a*, of beam members 22 and 24 respectively.

Figure 3:
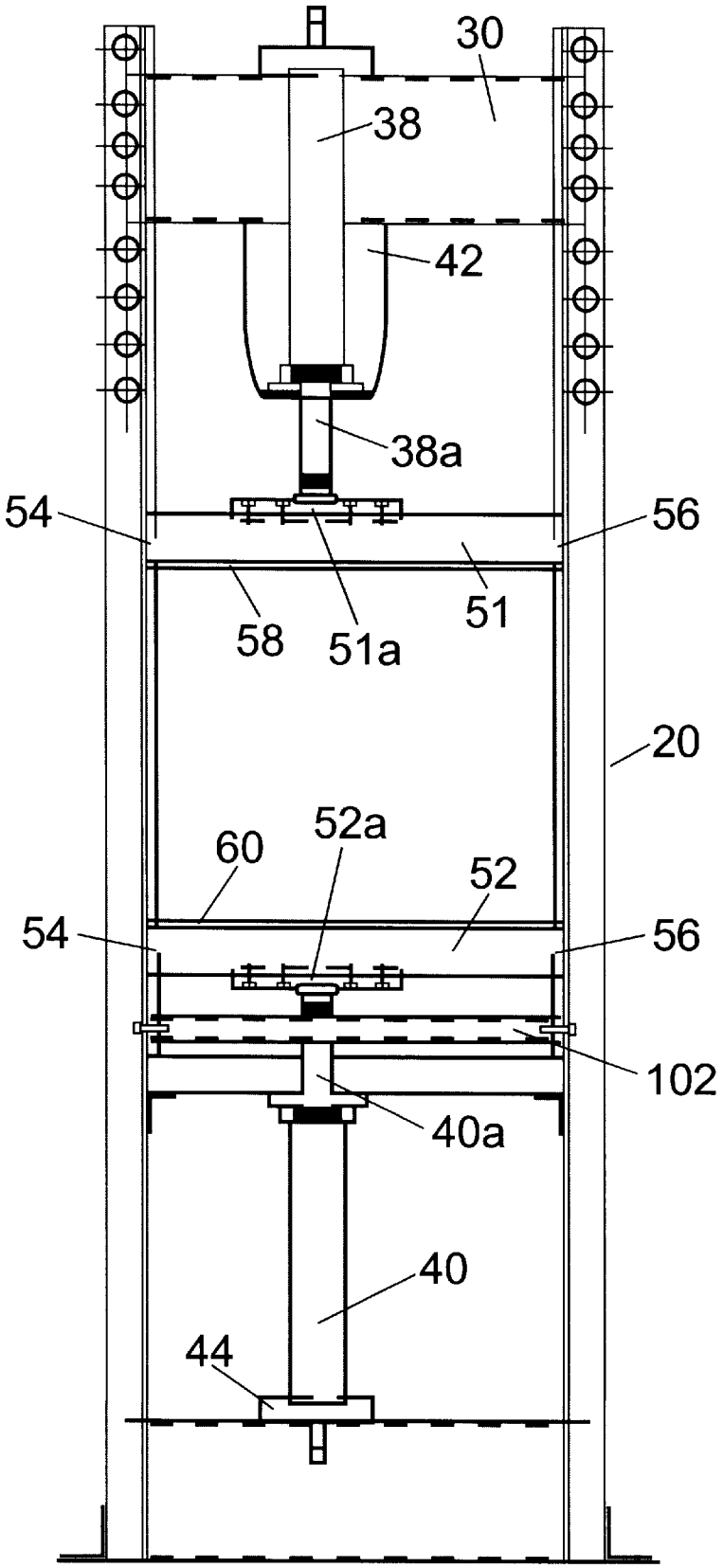
FIG. 3 is a cross-sectional view of the device taken essentially along the line 3—3 of FIG. 2, except that the platens are shown in a partially deployed position.

As can be seen viewing FIG. 3, the device 20 includes platen drive mechanism assemblies 38 and 40, respectively mounted within brackets 42 and 44. Mounting brackets 42 and 44, may be attached to their respective cross beam members 26 and 30, and 28 and 32, by any conventional means such as by mechanical fasteners or by welding.

Figure 5:
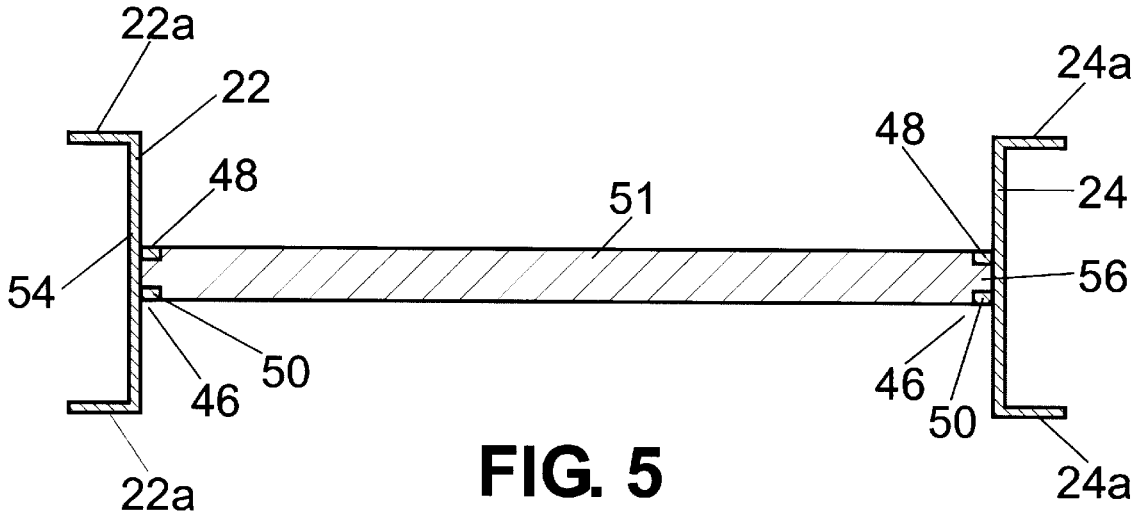
FIG. 5 is a cross-sectional view taken essentially along the line 5—5 of FIG. 1.

Each of beam members 22 and 24, are provided with a guide track 46 (see esp. FIG. 5), which is preferably formed from a pair of spaced flanges 48 and 50, that extend along the length of said beam members 22 and 24. Flanges 48 and 50, may be attached to the beam members 22 and 24, by any art-known means such as welding, for example.

Figure 4:
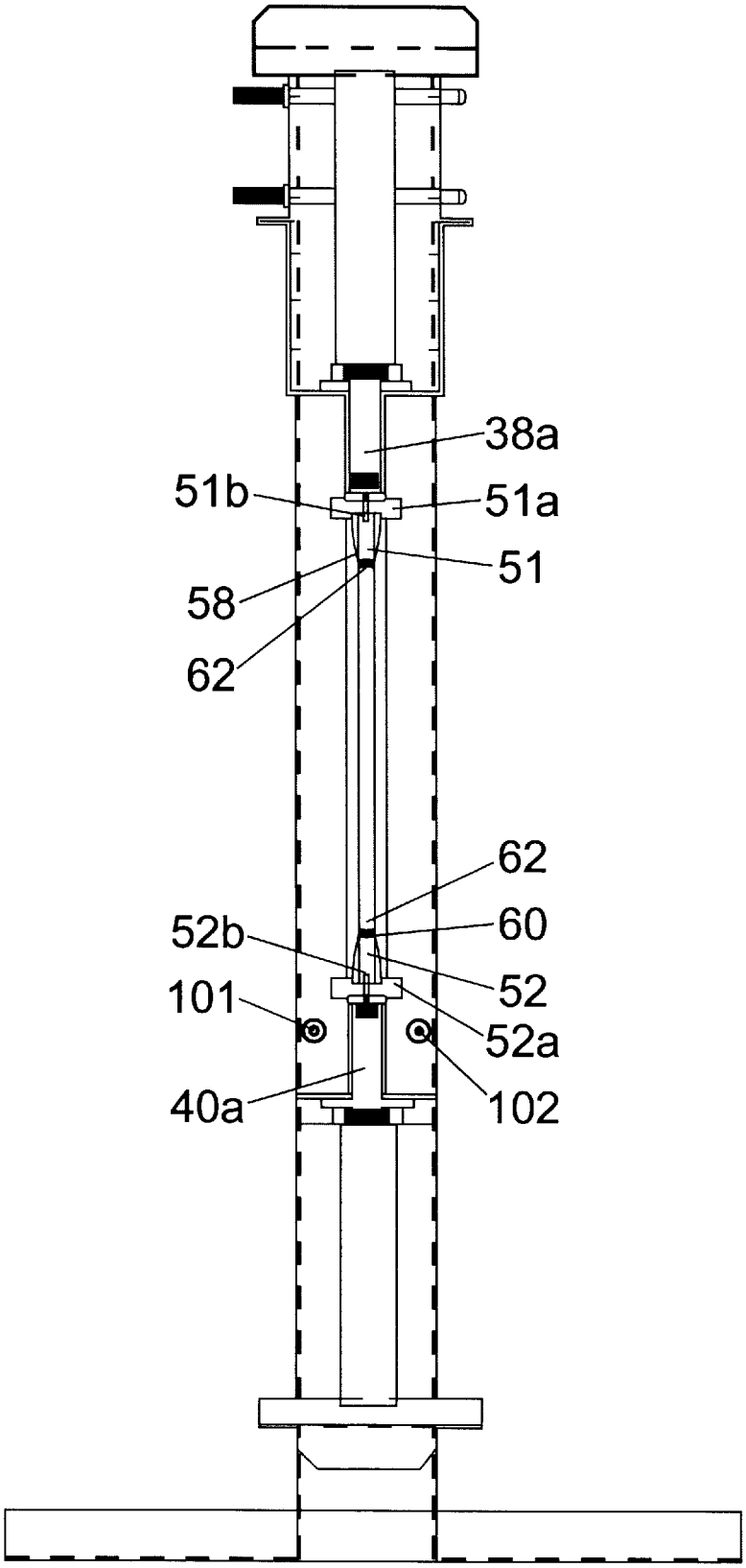
FIG. 4 is a cross-sectional view of the device taken essentially along the line 4—4 of FIG. 1, except that the platens are shown in a partially deployed position.

The device 20 also includes platens 51 and 52. These platens are best illustrated in FIGS. 3 and 4, which are cross-sectional views of the device 20. In FIGS. 3 and 4, the platens are shown in a partially deployed condition with plungers 38*a* and 40*a,* of respective platen drive mechanisms 38 and 40, partially extended. The platen 51 is attached to the outboard end of plunger 38*a,* via an attachment plate 51*a*. Likewise, platen 52 is attached to the outboard end of plunger 40*a,* via an attachment plate 52*a.*

With reference to FIG. 5 it can be seen that platen 51 extends longitudinally between beam members 22 and 24, and has a pair of flanges 54 and 56, which are received in corresponding guide tracks 46. That is to say, platen flanges 54 and 56, of platen 51 are configured to fit between beam flanges 48 and 50, so as to allow for reversible translation of platen 51 within its plane of action as a result of activation by platen drive mechanism 38. The configuration of platen 52 may be essentially the same as that of platen 51, in that it likewise has platen flanges 54 and 56, which fit between beam flanges 48 and 50, so as to allow for reversible translation of platen 52 within guide tracks 46, and thus the same plane of action as that of platen 51, as a result of activation by platen drive mechanism 40. Ease of movement of platens 51 and 52, may be enhanced by utilization of materials such as brass or TEFLON™ (polytetrafluorethylene) on the contact surfaces of the flanges and track, so as to minimize friction.

Platen drive mechanism assemblies 38 and 40, may be actuated by any art-known means, including mechanical, hydraulic, or pneumatic devices, and are mechanically coupled to platens 51 and 52 respectively. Thus, platen drive mechanism assemblies 38 and 40, actuate movement of respective platens 51 and 52, toward one another within the same plane of action as plungers 38*a* and 40*a,* are extended. This movement is caused by the actuation of cylinder assemblies 38, 40, and is guided by the guide tracks 46.

Both platen bale contacting surfaces 58 and 60, have a major axis extending longitudinally with respect to platens 51 and 52; with surfaces 58 and 60, further being in substantial parallel alignment relative to one another (see FIG. 3). Each of platens 51 and 52, have a longitudinally extending bale tie receiving recess 62 therein; this recess being dimensioned for ready placement of the bale tie during the process of bale repair and subsequent removal of the repaired bale from the device thereafter. As shown in FIG. 4, platens 51 and 52, are generally triangular in cross-section, with their respective bases 51*b* and 52*b,* being wider than their respective compressive surfaces 58 and 60. While other configurations are useable, this configuration is particularly desirable as it provides strength to the platen while minimizing compression surface area.

Figure 6:
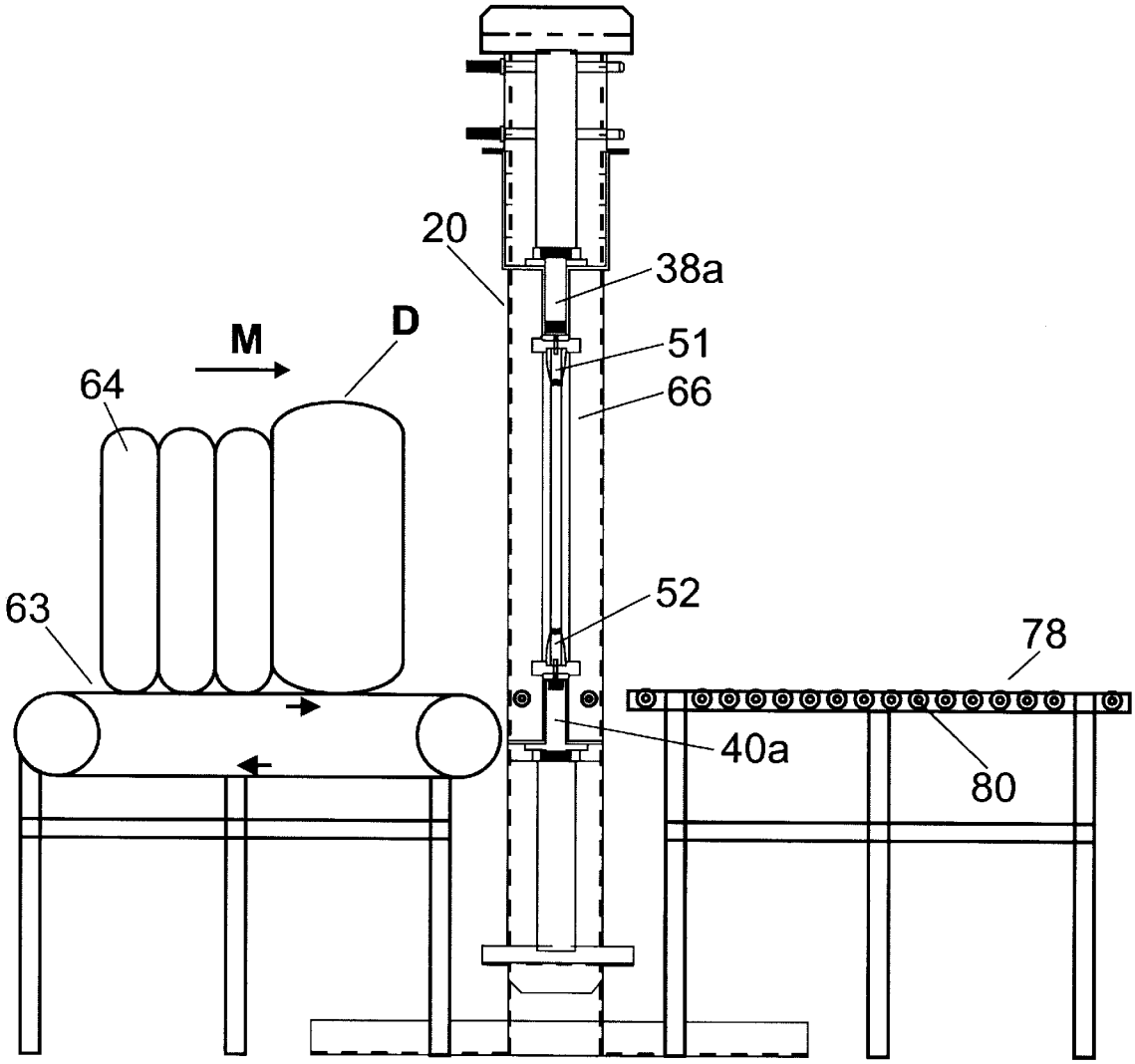
FIG. 6 is a view similar to FIG. 4, further illustrating infeed and outfeed bale conveyer mechanisms.
Figure 6A:
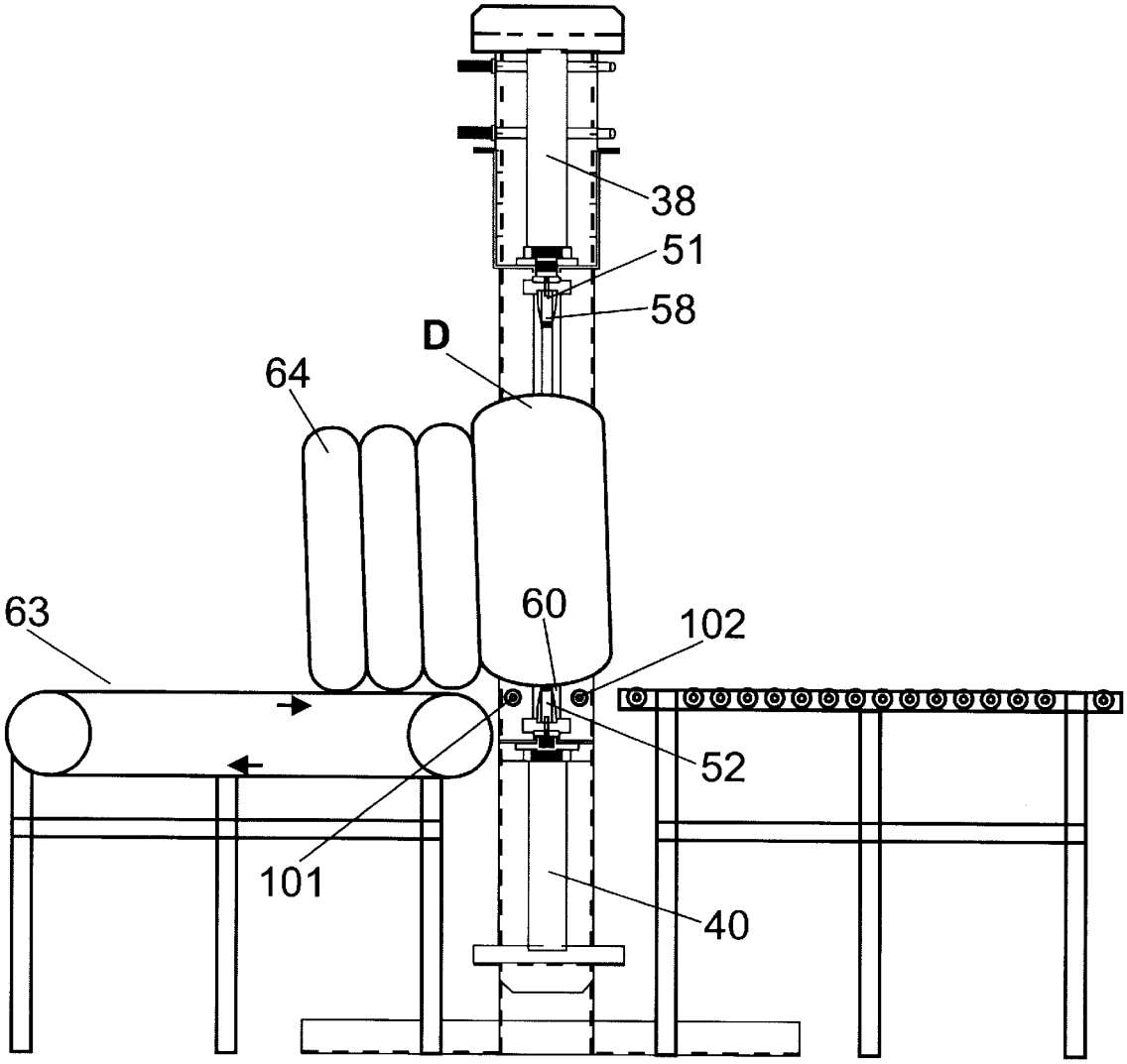
FIG. 6A is a view similar to FIG. 6, except that in this case a damaged bale is illustrated as being positioned in the plane of repair of the device.

With reference to FIG. 6, the device 20 may be equipped with a conveyor apparatus 63, which is situated beside the base frame structure 21. The conveyor 63 is disposed to transport a damaged bale 64 into the plane of repair 66, located between platens 51 and 52. As shown in FIGS. 3 and 4, platens 51 and 52, shown in FIG. 6, are positioned in a partially deployed condition with the plungers 38*a* and 40*a,* partially extended. In contrast FIG. 6A shows the position of platens 51 and 52, when the plungers have been fully retracted. The purpose of conveyor apparatus 63 is to move the damaged portion D, of the bale 64, into the plane of repair 66. To do this platens 51 and 52, must be in a substantially retracted condition so as to provide clearance for the damaged portion D of the bale 64.

In accordance with the invention, bale 64 is moved in the direction of the arrow M in FIG. 6 and the platens 51 and 52, are fully retracted so that the bale 64 and platens 51 and 52, assume the positions shown in FIG. 6A. Rollers 101 and 102, may be mounted on the base frame structure 21 as shown, to facilitate movement of the damaged bale into and out of the plane of repair 66. Cylinder assemblies 38 and 40, are then actuated to move platens 51 and 52 toward one another, whereby platen surfaces 58 and 60, are brought into compressive contact with bale 64 at the damaged portion D thereof. Platen surfaces 58 and 60, are dimensioned so as to compress a damaged bale 64 only in close proximity to the area where a single tie is to be placed. As mentioned above, the width of platen surfaces 58 and 60, should be no more than about 4 inches and preferably may be about 1 inch.

Platen surfaces 58 and 60, of platens 51 and 52, are thus positioned for compressing a damaged bale therebetween, as the platens move within the same plane toward one another. Likewise, platen drive mechanism assemblies 38 and 40, are operable to move platens 51 and 52 respectively, so that a damaged bale 64 is compressed between platen surfaces 58 and 60.

While the bale is compressed between platen surfaces 58 and 60, the bale tie which was placed in the bale tie receiving recess 62 of the platen before compression, may be appropriately secured to thereby repair the damaged bale.

Figure 7A:
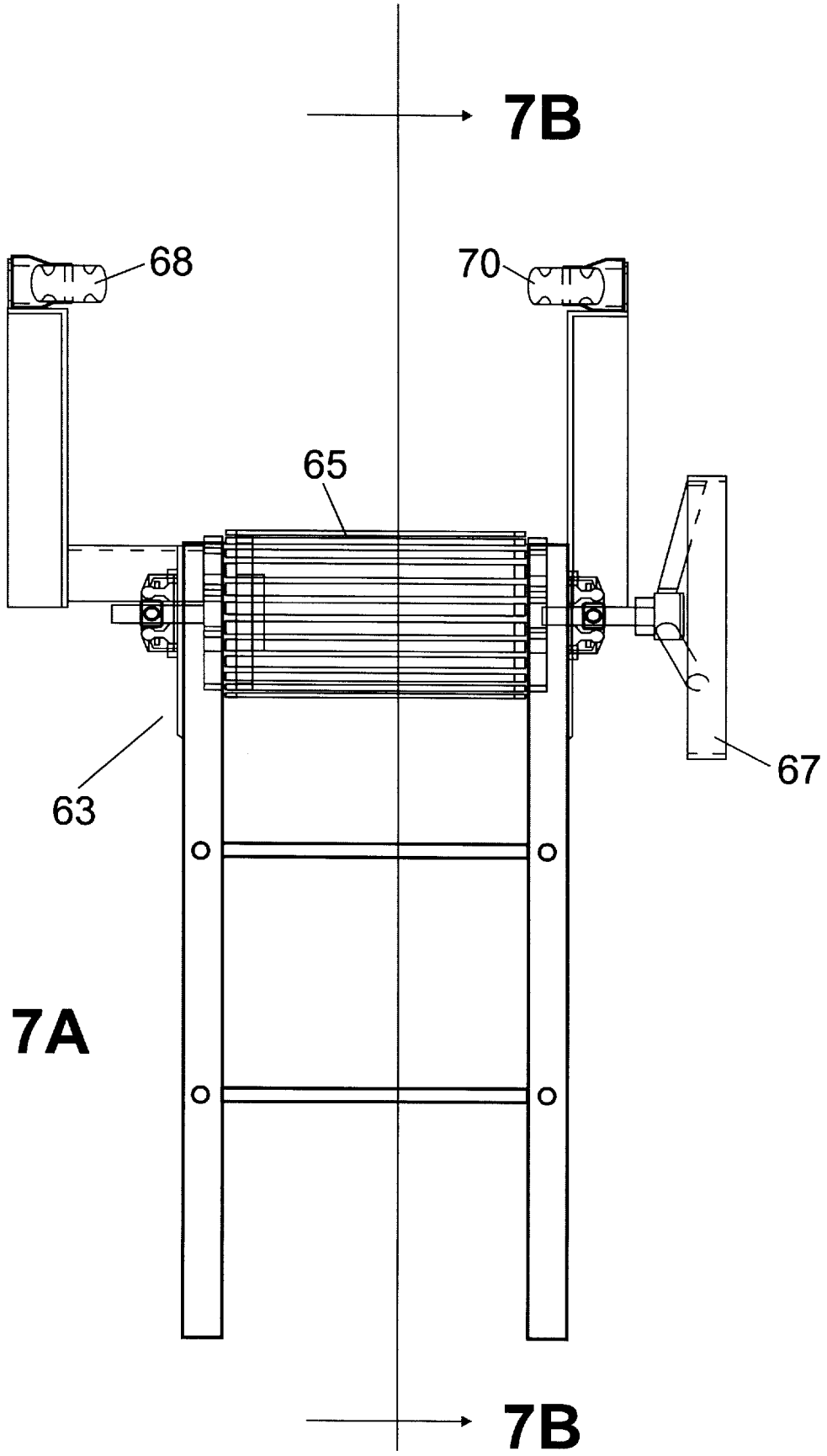
FIG. 7A is a detailed and enlarged end view of the conveyor of FIG. 6.
Figure 7B:
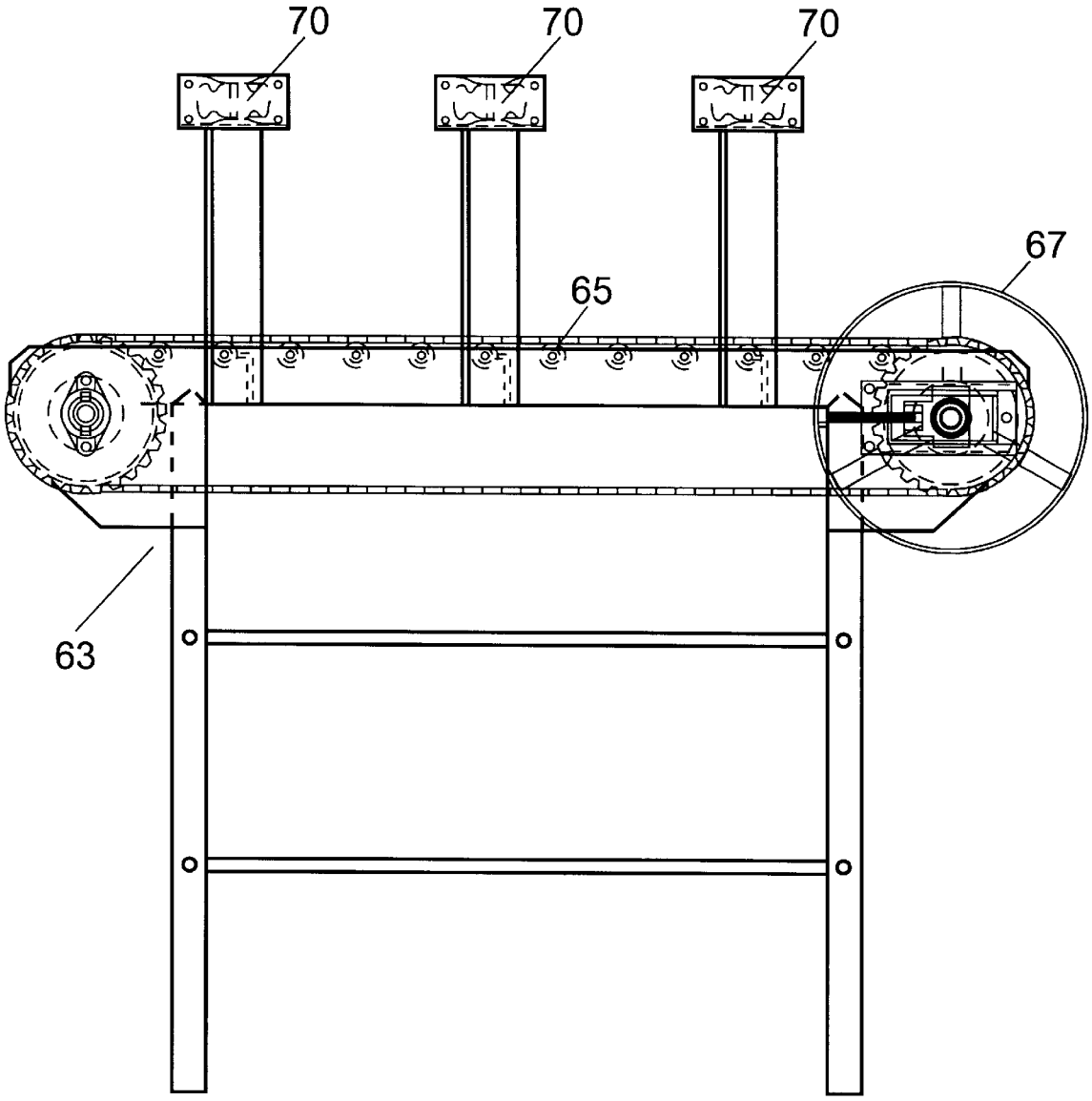
FIG. 7B is a cross-sectional view of the conveyor taken essentially along the line 7—7 of FIG. 7A.

Conveyor 63, shown in detail in FIGS. 7A and 7B, is used for transporting a damaged bale 64 into the plane of repair 66. Conveyor 63, may preferably include a conveyor belt 65, and may be powered in a conventional manner such as by using an electric motor, hydraulic pump, or pneumatic pump. Alternatively, a hand wheel 67, as illustrated in FIGS. 7A and 7B, may be employed to cause translocation of bale 64 into the plane of repair 66, via belt 65. Furthermore, as illustrated in FIGS. 7A and 7B, conveyor 63 may be provided with side coasters 68 and 70, to assist in centering bale 64 between platens 51 and 52, during movement of the bale into the plane of repair 66.

Figure 10:
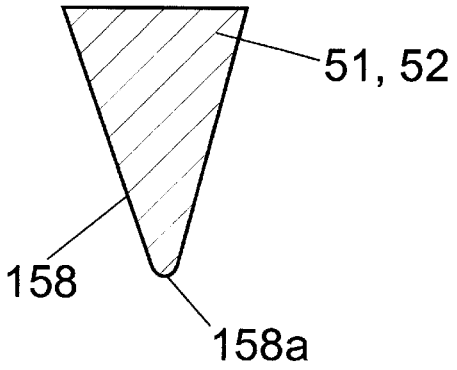
FIG. 10 is a cross-sectional view illustrating an alternate platen embodiment.
Figure 8:
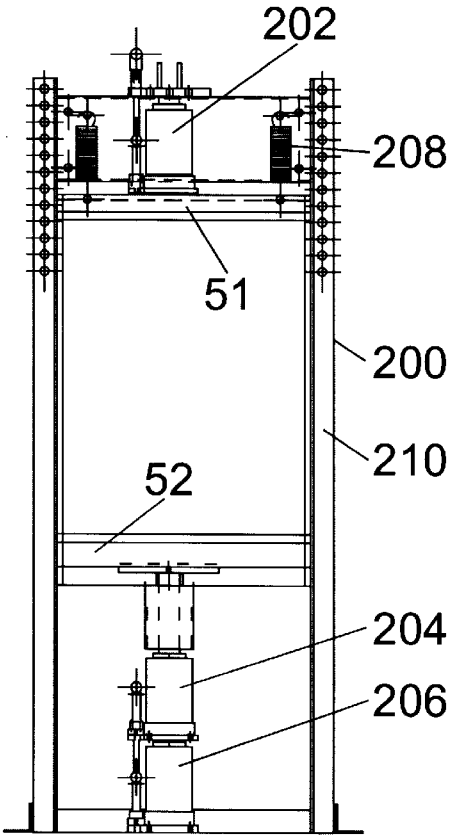
FIG. 8 is a cross-sectional front elevational view of a second embodiment of the device.
Figure 9:
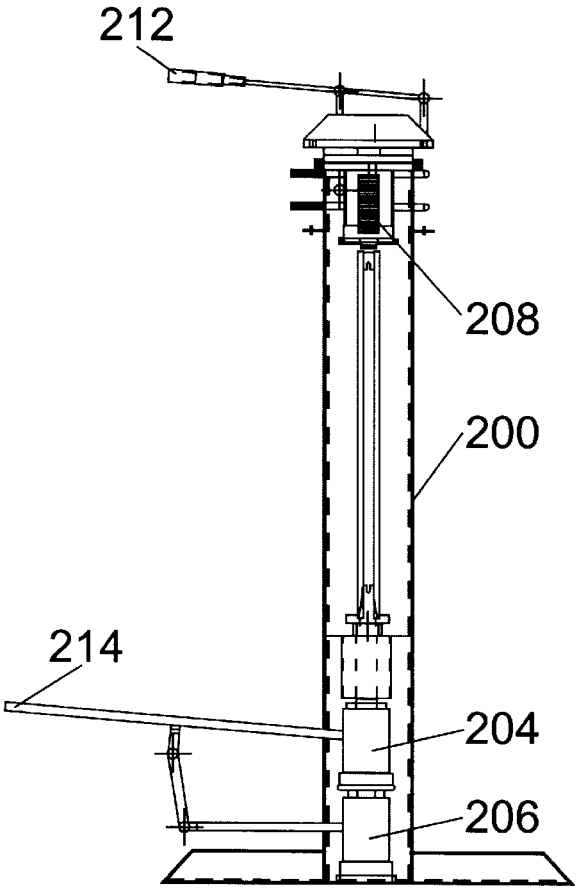
FIG. 9 is a cross-sectional side elevational view illustrating the embodiment of FIG. 8.

One or both of platens 51 and 52, are configured to include a bale tie receiving recess 62, whereby a bale tie may be positioned prior to bale compression. In an alternate embodiment one or both of the two platens may have a cross-sectional configuration such as that which is shown in FIG. 10. Thus, this platen may have a wedge-shaped surface 158, providing a flat or v-shaped nose portion 158*a,* which is positioned to point toward the damaged bale to be repaired. When a platen of this shape is used, the bale tie may either be placed upon the nose portion 158*a,* prior to bale compression or, subsequent to bale compression, put in position by placement alongside the platen body. FIGS. 8 and 9, illustrate an alternate embodiment of the device 200 which employs manually operated jacks 202, 204 and 206, to move platens 51 and 52 toward one another, and thereby compress a damaged bale therebetween. The 3 jacks are mounted in series to deliver a total stroke of 20 inches, which is generally needed. Commercially available jacks conventionally have a stroke of only about 7 inches. In alternative embodiments, the skilled artisan could design systems with jacks having sufficient stroke so that only one would be required at either one or both ends of the device 200.

Springs 208 are provided to retract platen 51 after bale repair has been completed. When operated in a vertical mode, the weight of the bale itself will operate to retract jacks 204 and 206 from platen 52. In an alternative embodiment where such is not the case, springs could likewise be installed for retraction of platen 52 subsequent to bale repair. Base frame structure 210 of the device 200, may be constructed in essentially the same way as the base frame 21 of the device 20. Accordingly, it is believed unnecessary to describe the exact details of the frame structure 210. Jacks 204, 206 and 208, are actuated using levers 212 and 214 to move platens 51 and 52, in essentially the same way as is done by platen drive mechanism assemblies 38 and 40.

FIGS. 6 and 6A show a table 78 equipped with a bed of rollers 80, that may be positioned adjacent the device 20 to assist in removing the bale from the apparatus after the bale has been repaired.

Thus, the invention provides an inexpensive transportable device for recompressing a damaged bale of material such as cotton, only in an area proximate to a broken or missing bale tie. In accordance with the invention, the device includes innovative compression platens that are preferably and desirably only about 0.75 inches wide and about 21 inches long, with a 0.25-inch wide longitudinal recess on the bale contact surface to allow a replacement tie to remain concealed during compression. Through the use of such a platen, only about 1.5% of the bale face needs to be compressed. Sufficient force is applied to the affected area of the bale so as to compress it to a thickness of 19–20 inches. A new tie is then applied and secured, and the bale is released.

When four ties are broken on a typical damaged bale, the bale may expand to a height of approximately 40 inches. The force required for recompression of the bale in a defective area increases exponentially as a function of cotton density. Tests conducted using a platen having a length of 21 inches, a compression width of 4 inches, and a 1 inch longitudinally extending bale tie receiving recess in the center of the compression surface, provided the following data:

TABLE I

| Test No. | Force applied, tons | Platen separation achieved, inches |
|---|---|---|
| 1 | 6 | 26.25 |
| 1 | 10 | 25.25 |
| 1 | 12 | 24.375 |
| 1 | 20 | 23.44 |
| 2 | 0 | 26.59 |
| 2 | 5 | 25.03 |
| 2 | 10 | 23.625 |
| 2 | 15 | 22.625 |
| 2 | 16 | 22.19 |
| 3 | 5 | 26.54 |
| 3 | 10 | 25.00 |
| 3 | 15 | 23.88 |
| 3 | 20 | 22.81 |

To determine the significance of the width of the platen compression surface, further tests were conducted using a 21 inch long platen having a compression surface width of 0.875 inches, and a 0.25 inch center groove. These tests provided the following further data:

TABLE II

| Test No. | Force applied, tons | Platen separation achieved, inches |
|---|---|---|
| 4 | 0 | 0 |
| 4 | 5 | 23.25 |
| 4 | 10 | 21.75 |
| 4 | 15 | 20.50 |
| 4 | 20 | 19.75 |

An analysis of the foregoing data suggests strongly that the compression area should be as small as possible, depending primarily on the strength and ability of the platen itself to withstand the forces to which it is subjected. Thus, a platen which has a generally triangular cross-sectional configuration is preferred to provide a compression surface having a minimal compression area, coupled with maximum strength.

As explained above, two embodiments of the device are contemplated at the present time, one of which is manually operated and the other of which is operated automatically. The automated version includes hydraulic cylinders that deliver about 30 tons of force to the compression platens. The manually operated embodiment employs 3 hand-operated, 30-ton, 7-inch stroke hydraulic jacks. Bale entrance and exit is provided by suitable conveying mechanisms, so that only a single operator is necessary. The bale to be repaired is positioned so that the platens are near a defective area, and the drive mechanism is then actuated to compress only that area of the bale where a bale tie has failed to a total height of about 20 inches. A replacement tie may then be applied. The pressure may be released and the sequence repeated if a given bale has experienced multiple bale tie failures.

The device for repairing cotton bales in accordance with the invention provides a means for repairing defective bales of cotton on site. Only a single operator is required for a period of about ten to thirty minutes to replace up to four defective ties. This compares very favorably with known procedures and devices where as many as four operators are required for thirty minutes, using a full size baling press that currently markets for more than $300,000. The cost of the automatic device of the present invention may be only about $8,000, and the cost of the manually-operated press may be as low as about $3,000.

In accordance with the invention, repair may be accomplished without interruption of the ginning operation. Repair may also be accomplished at a warehouse or textile mill where no bale press is available. Since bales from several gins are often consolidated at a central warehouse, repair may be accomplished at such a warehouse.

As will readily be recognized by those of ordinary skill in the art to which the present invention pertains, the device may be readily adapted for transport.

In accordance with the invention, the device for repairing bales which have been damaged as a result of bale tie failure, is intended to meet the needs of the individual cotton gin or warehouse where there is a need to replace a relatively small number of bale ties annually.

While the devices described above include drive mechanisms optionally comprised of a plurality of fluid operated cylinder assemblies or manual jacks, it will be readily appreciated by those of ordinary skill in the art that the device could be arranged so as to require only a single cylinder assembly or a single jack, assuming that a cylinder assembly and/or jack having a stroke of 20 inches or more were available. With such an arrangement, only one of the platens would need to move during the compression stroke. But even if only one platen moves, the platens still would move relatively toward and away from one another to compress and/or release the damaged bale.

The operating technique utilized in accordance with the invention, is for a damaged bale to be placed on the conveyor belt 65 using a fork lift type apparatus or the like. Once the bale is on the conveyor belt 65, the damaged portion thereof may be moved into the plane of repair 66, of the device 20, by manually turning the hand wheel 67. As can be seen from the drawings, the plane of repair 66 is between platens 51 and 52. The cylinders and/or jacks should be substantially retracted at the time the bale is moved to bring the damaged portion into the plane of repair 66. The cylinders and/or jacks are then activated so that the bale is compressed until the platens are about 19 to 20 inches apart. At this point the bale tie, which may already be in place as explained above, is fastened in the usual way. The platens may then be retracted and the bale is moved either from the device, or to a new position if multiple bale tie failures have been experienced. In this latter regard, it will be recognized by those of ordinary skill in the art that the device could include a repair zone wide enough to contain and support an entire bale, whereby an operator could simply move the repair device itself from point to point without moving the bale.

I claim:

1. A device for inserting or replacing a bale tie, said device comprising:

a base frame structure;

one or more pairs of contraposed platens, each platen being provided with elongated, generally longitudinally extending bale contacting and compressing surfaces having a longitudinally extending major axis, with one or both of said platens being mounted on said structure for reversible translation toward and away from the other within a common plane of action, with said platen compression surfaces being disposed in substantial parallelism to one another, and with said surfaces located in substantial alignment and positioned for compressing a bale of material therebetween, as one or both of the platens move toward one another, said surfaces each having a dimension in a direction perpendicular to the major axis thereof, which is sufficiently small so as to compress a bale of material only in close proximity to a location where a single bale tie is to be placed; and a drive mechanism that is coupled to one or both of each of said platens and operable, to move the platens toward one another to thereby compress a bale of material between said surfaces.

2. A device as set forth in claim 1, wherein a longitudinally extending bale tie receiving recess is provided in at least one of each pair of said platen compression surfaces.

3. A device as set forth in claim 1, wherein a longitudinally extending bale tie receiving recess is provided in each of said platen compression surfaces.

4. A device as set forth in claim 3, wherein said platens possess a pair of flanges, and wherein said base frame structure includes a pair of spaced beam members, each beam member having a pair of longitudinally extending flanges which form a guide track which extends therebetween; said platens each being disposed such that each of their flanges seat within the guide tracks of said beam members with which they are in respective contact.

5. A device as set forth in claim 1, wherein said platens possess a pair of flanges, and wherein said base frame structure includes a pair of spaced beam members, each beam member having a pair of longitudinally extending flanges which form a guide track which extends therebetween; said platens each being disposed such that each of their flanges seat within the guide tracks of said beam members with which they are in respective contact.

6. A device as set forth in claim 1, wherein said drive mechanisms comprise a mechanical, hydraulic, or pneumatically operated cylinder assembly.

7. A device as set forth in claim 1, wherein said drive mechanism comprises a manually operated jack.

8. A device as set forth in claim 1, wherein each of said platen compression surfaces is wedge shaped and has a v-shaped nose portion disposed to point toward a damaged cotton bale to be repaired.

9. A device as set forth in claim 8, wherein said platens possess a pair of flanges, and wherein said base frame structure includes a pair of spaced beam members, each beam member having a pair of longitudinally extending flanges which form a guide track which extends therebetween; said platens each being disposed such that each of their flanges seat within the guide tracks of said beam members with which they are in respective contact.

10. A device as set forth in claim 1, wherein at least one of said platen compression surfaces is provided with a longitudinally extending bale tie accommodating recess.

11. A device as set forth in claim 1, wherein each of said platen compression surfaces is provided with a longitudinally extending bale tie accommodating recess.

12. A device as set forth in claim 11, wherein said platens possess a pair of flanges, and wherein said base frame structure includes a pair of spaced beam members, each beam member having a pair of longitudinally extending flanges which form a guide track which extends therebetween; said platens each being disposed such that each of their flanges seat within the guide tracks of said beam members with which they are in respective contact.

13. A device as set forth in claim 1, wherein said device includes a conveyor apparatus situated beside said base frame structure and disposed to transport a damaged bale into the plane of repair located between said platens.

14. A device as set forth in claim 1, wherein each of said platens is mounted for vertical movement relative to said base frame structure.

15. A method for repairing bales which have been damaged as a result of bale tie failure, said method comprising:

placing a damaged bale in a plane of repair between two platen compression surfaces, wherein at least one of said platen compression surfaces is wedge shaped and has a v-shaped nose portion disposed to point toward a damaged bale to be repaired;

compressing said damaged bale only in close proximity to the location where a bale tie is to be placed; and installing said bale tie around said bale at said position.

16. A method as set forth in claim 15, wherein said damaged bale is compressed at said position between platens having longitudinally extending major axes, said platens each having a cross-sectional dimension in a direction perpendicular to the major axis thereof, which is sufficiently small so as to compress a damaged bale only in close proximity to the location where a bale tie is to be placed.

17. A method as set forth in claim 16, wherein a longitudinally extending bale tie receiving recess is provided in at least one of said platen compression surfaces.

18. A method as set forth in claim 17, wherein a bale tie is placed in said recess before the bale is compressed between said platen compression surfaces.

19. A method as set forth in claim 16, wherein a longitudinally extending bale tie receiving recess is provided in each of said platen compression surfaces.

20. A method as set forth in claim 19, wherein a bale tie is placed in said recess before the bale is compressed between said platen compression surfaces.

21. A method as set forth in claim 16, wherein each of said platen compression surfaces is wedge shaped and has a v-shaped nose portion disposed to point toward a cotton bale to be repaired.

* * * * *